US010241458B2

(12) United States Patent
Watanabe et al.

(10) Patent No.: US 10,241,458 B2
(45) Date of Patent: Mar. 26, 2019

(54) IMAGE FORMING APPARATUS

(71) Applicant: KYOCERA Document Solutions Inc., Osaka-shi, Osaka (JP)

(72) Inventors: Takeshi Watanabe, Osaka (JP); Arata Nakamura, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 5 days.

(21) Appl. No.: 15/670,773

(22) Filed: Aug. 7, 2017

(65) Prior Publication Data

US 2018/0046125 A1 Feb. 15, 2018

(30) Foreign Application Priority Data

Aug. 10, 2016 (JP) ..... 2016-157192

(51) Int. Cl.
*G03G 15/16* (2006.01)
*G03G 15/00* (2006.01)
*G03G 15/08* (2006.01)

(52) U.S. Cl.
CPC ..... *G03G 15/657* (2013.01); *G03G 15/0808* (2013.01); *G03G 15/1675* (2013.01); *G03G 15/6558* (2013.01); *G03G 15/5008* (2013.01); *G03G 15/607* (2013.01); *G03G 15/6561* (2013.01); *G03G 2215/00675* (2013.01)

(58) Field of Classification Search
CPC ..... G03G 15/657; G03G 15/0808; G03G 15/1675; G03G 15/5008; G03G 15/607; G03G 15/16
See application file for complete search history.

(56) References Cited

U.S. PATENT DOCUMENTS 5,592,278 A * 1/1997 Sato ..... G03G 15/164 271/264
5,617,193 A * 4/1997 Ban ..... G03G 15/657 399/316
7,319,832 B2 * 1/2008 Nishimura ..... G03G 21/1828 399/107

(Continued)

FOREIGN PATENT DOCUMENTS

JP 2010107636 A 5/2010

*Primary Examiner* — Thomas A Morrison
(74) *Attorney, Agent, or Firm* — Alleman Hall Creasman & Tuttle LLP

(57) ABSTRACT

A sheet guide of an image forming apparatus includes a first upstream guide member and a first downstream guide member. The first upstream guide member includes an upstream front guide surface and an upstream rear guide surface. The first downstream guide member includes a downstream front guide surface and a downstream rear guide surface. The downstream front guide surface intersects with an imaginary plane formed by extending, toward a downstream side in a conveyance direction of a sheet, the upstream rear guide surface. The upstream front guide surface intersects with an imaginary plane that is formed by extending, toward an upstream side in the conveyance direction, the downstream rear guide surface. When viewed from a direction perpendicular to the upstream rear guide surface, an edge portion of the first upstream guide member on the downstream side is inclined with respect to a width direction perpendicular to the conveyance direction.

3 Claims, 6 Drawing Sheets

(56) References Cited

U.S. PATENT DOCUMENTS

| | | | | |
|---|---|---|---|---|
| 2005/0201789 | A1* | 9/2005 | Yuminamochi | G03G 15/657 399/390 |
| 2010/0104331 | A1 | 4/2010 | Matsuno | |
| 2011/0081182 | A1* | 4/2011 | Takiguchi | G03G 15/657 399/400 |
| 2013/0148988 | A1* | 6/2013 | Murakami | B65H 29/52 399/21 |
| 2013/0202325 | A1* | 8/2013 | Takeuchi | G03G 15/2046 399/69 |
| 2016/0091833 | A1* | 3/2016 | Okamoto | G03G 15/161 399/316 |

* cited by examiner

IMAGE FORMING APPARATUS

INCORPORATION BY REFERENCE

This application is based upon and claims the benefit of priority from the corresponding Japanese Patent Application No. 2016-157192 filed on Aug. 10, 2016, the entire contents of which are incorporated herein by reference.

BACKGROUND

The present disclosure relates to an image forming apparatus.

Typically, an electrophotographic image forming apparatus includes an image carrying member and an image transfer member, wherein the image carrying member carries a toner image, and the image transfer member transfers the toner image from the image carrying member to a sheet. Furthermore, the image forming apparatus includes a sheet guide that guides a forward end of the sheet conveyed by a pair of registration rollers, to a target position on the outer circumferential surface of the image carrying member.

The target position is located between a developing position and a transfer position on the outer circumferential surface of the image carrying member, closer to the transfer position than to the developing position. At the transfer position, a transfer nip portion is formed between the image carrying member and the image transfer member.

After the forward end of the sheet reaches the target position, the forward end of the sheet moves to the transfer position along the outer circumferential surface of the image carrying member. The sheet then passes through the transfer nip portion.

The sheet guide includes a first sheet guide and a second sheet guide that respectively face a first surface and a second surface of the sheet, wherein the first surface is a side of the sheet to which the image is transferred, and the second surface is opposite to the first surface.

In many cases, each of the first sheet guide and the second sheet guide is composed of a plurality of guide members. With this configuration, the sheet guide for guiding the sheet along an intended curved path can be configured from a plurality of members that are relatively small and have simple shapes.

For example, the first sheet guide may include an upstream first guide member and a downstream first guide member that are respectively disposed on the upstream side and the downstream side in the sheet conveyance direction.

SUMMARY

An image forming apparatus according to an aspect of the present disclosure includes an image carrying member, a developing unit, an image transfer member, a pair of conveyance rollers, and a sheet guide. The image carrying member is configured to rotate in a predetermined direction and on whose outer circumferential surface, an electrostatic latent image is formed. The developing unit develops the electrostatic latent image as a toner image at a developing position on the outer circumferential surface of the image carrying member. The image transfer member rotates facing a transfer position on the outer circumferential surface of the image carrying member, and transfers the toner image to a first surface of the sheet, while conveying the sheet between it and the image carrying member. The pair of conveyance rollers convey the sheet toward the image carrying member. The sheet guide is disposed between the pair of conveyance rollers and the image carrying member. The sheet guide has a first guide surface and a second guide surface that respectively face a first surface and a second surface of the sheet, wherein the second surface is opposite to the first surface. The sheet guide guides a forward end of the sheet conveyed by the pair of conveyance rollers to a target position between the developing position and the transfer position on the outer circumferential surface of the image carrying member. The sheet guide includes a first upstream guide member and a first downstream guide member. The first upstream guide member includes an upstream front guide surface and an upstream rear guide surface that constitute a part of the first guide surface and are arranged in sequence from an upstream side to a downstream side in a conveyance direction of the sheet. The first upstream guide member further includes a first intermediate convex portion that has a convex shape and is formed to project toward the second guide surface at a boundary between the upstream front guide surface and the upstream rear guide surface. The first downstream guide member is separate from the first upstream guide member. The first downstream guide member includes a downstream front guide surface and a downstream rear guide surface that, on the downstream side of the upstream rear guide surface in the conveyance direction, constitute another part of the first guide surface and are arranged in sequence from the upstream side to the downstream side in the conveyance direction. The first downstream guide member further includes a second intermediate convex portion that has a convex shape and is formed to project toward the second guide surface at a boundary between the downstream front guide surface and the downstream rear guide surface. The downstream front guide surface intersects with an imaginary plane that is formed by extending, toward the downstream side in the conveyance direction, the upstream rear guide surface. The upstream front guide surface intersects with an imaginary plane that is formed by extending, toward the upstream side in the conveyance direction, the downstream rear guide surface. When viewed from a direction perpendicular to the upstream rear guide surface, an edge portion of the first upstream guide member that is located on the downstream side in the conveyance direction, is inclined with respect to a width direction perpendicular to the conveyance direction.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings. It should be noted that the following embodiment is an example of a specific embodiment of the present disclosure and should not limit the technical scope of the present disclosure.

[Configuration of Image Forming Apparatus 10]

Figure 1:
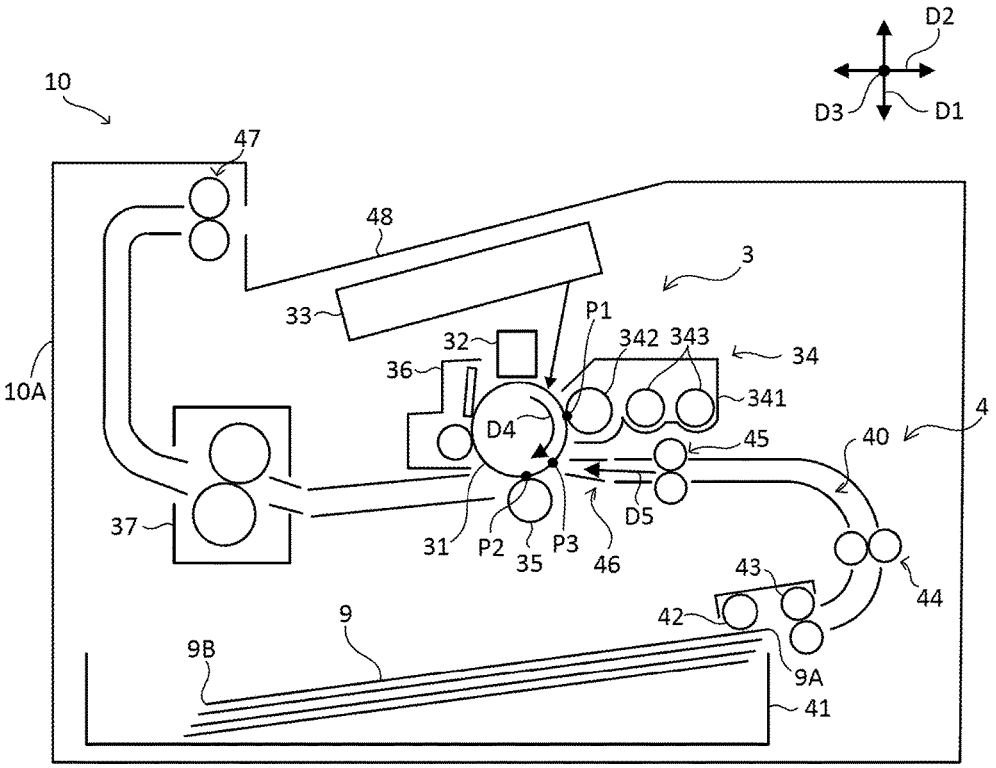
FIG. 1 is a configuration diagram of an image forming apparatus according to an embodiment of the present disclosure.

As shown in FIG. 1, an image forming apparatus 10 according to an embodiment includes, in a main body portion 10A, a sheet conveyance mechanism 4 and a print processing device 3. In the drawings, an up-down direction D1, a depth direction D2, and a width direction D3 determined based on the installed image forming apparatus 10, are indicated with arrows.

The image forming apparatus 10 is a printer having a print function to form an image on a sheet 9 based on image data. It is noted that the image forming apparatus 10 is applicable to image forming apparatuses such as a facsimile apparatus, a copier, and a multifunction peripheral.

The print processing device 3 shown in FIG. 1 forms a toner image on the sheet 9 by an electrophotographic system. For example, the print processing device 3 executes an image forming process based on image data obtained from an external information processing apparatus such as a personal computer.

The print processing device 3 includes a drum-like photoconductor 31, a charging unit 32, a laser scanning unit 33, a developing unit 34, an image transfer member 35, a cleaning unit 36, and a fixing unit 37. The photoconductor 31 is, for example, an organic photoconductor.

In the print processing device 3, the charging unit 32 charges an outer circumferential surface of the photoconductor 31 that rotates in a predetermined rotation direction D4. The laser scanning unit 33 writes an electrostatic latent image to the charged outer circumferential surface of the photoconductor 31 by scanning a laser beam. It is noted that the photoconductor 31 is an example of the image carrying member on whose outer circumferential surface the electrostatic latent image is formed.

The developing unit 34 develops the electrostatic latent image as a toner image at a developing position P1 on the outer circumferential surface of the photoconductor 31. The developing position P1 is, on the outer circumferential surface of the photoconductor 31, on the downstream side of a position where the electrostatic latent image is written, in the rotation direction D4.

The developing unit 34 includes a housing 341 and a developing roller 342, wherein the housing 341 stores toner, and the developing roller 342 supplies the toner in the housing 341 to the outer circumferential surface of the photoconductor 31. Furthermore, the developing unit 34 includes a stirring member 343 that circulates the toner in the housing 341 while stirring the toner.

The developing unit 34 is attached to the main body portion 10A in a detachable manner. This allows a deteriorated developing unit 34 to be replaced with a new developing unit 34.

The image transfer member 35 is a rotator that rotates facing a transfer position P2 on the outer circumferential surface of the photoconductor 31. The image transfer member 35 transfers the toner image formed on the outer circumferential surface of the photoconductor 31, to a surface of the sheet 9, while conveying the sheet 9 between it and the photoconductor 31. On the outer circumferential surface of the photoconductor 31, the transfer position P2 is on the downstream side of the developing position P1 in the rotation direction D4.

An outer layer portion of the image transfer member 35 is formed from an elastic member such as EPDM (Ethylene Propylene Diene Monomer) rubber. The sheet 9 is pressed against the outer circumferential surface of the photoconductor 31 by the elastic member constituting the outer layer of the image transfer member 35.

The cleaning unit 36 removes toner that has remained on the outer circumferential surface of the photoconductor 31 at a position located on the downstream side of the transfer position P2 in the rotation direction D4 on the outer circumferential surface of the photoconductor 31.

The sheet conveyance mechanism 4 conveys the sheet 9 fed from a sheet storage portion 41 along a conveyance path 40 provided in the main body portion 10A, and discharges the sheet 9 from the conveyance path 40 onto a discharge tray 48. The sheet conveyance mechanism 4 includes a pick-up roller 42, a feed roller 43, a pair of relay rollers 44, a pair of registration rollers 45, a sheet guide 46, and a pair of discharge rollers 47.

The pick-up roller 42 and the feed roller 43 feed the sheets 9 one by one from the sheet storage portion 41 to the conveyance path 40. The pair of relay rollers 44, the pair of registration rollers 45, and the pair of discharge rollers 47 convey the sheet 9 by rotating while nipping the sheet 9.

The pair of relay rollers 44, the pair of registration rollers 45, the sheet guide 46, the photoconductor 31, the fixing unit 37, and the pair of discharge rollers 47 are arranged in the stated order from the upstream side in a conveyance direction D5 of the sheet 9 in the conveyance path 40.

The pair of relay rollers 44 convey the sheet 9 fed from the feed roller 43, toward the pair of registration rollers 45 disposed on the downstream side.

The pair of registration rollers 45 temporarily stop the sheet 9 that has been conveyed via the pair of relay rollers 44, and convey the sheet 9 toward the photoconductor 31. The pair of registration rollers 45 are an example of the pair of conveyance rollers that convey the sheet 9 toward the photoconductor 31.

Figure 2:
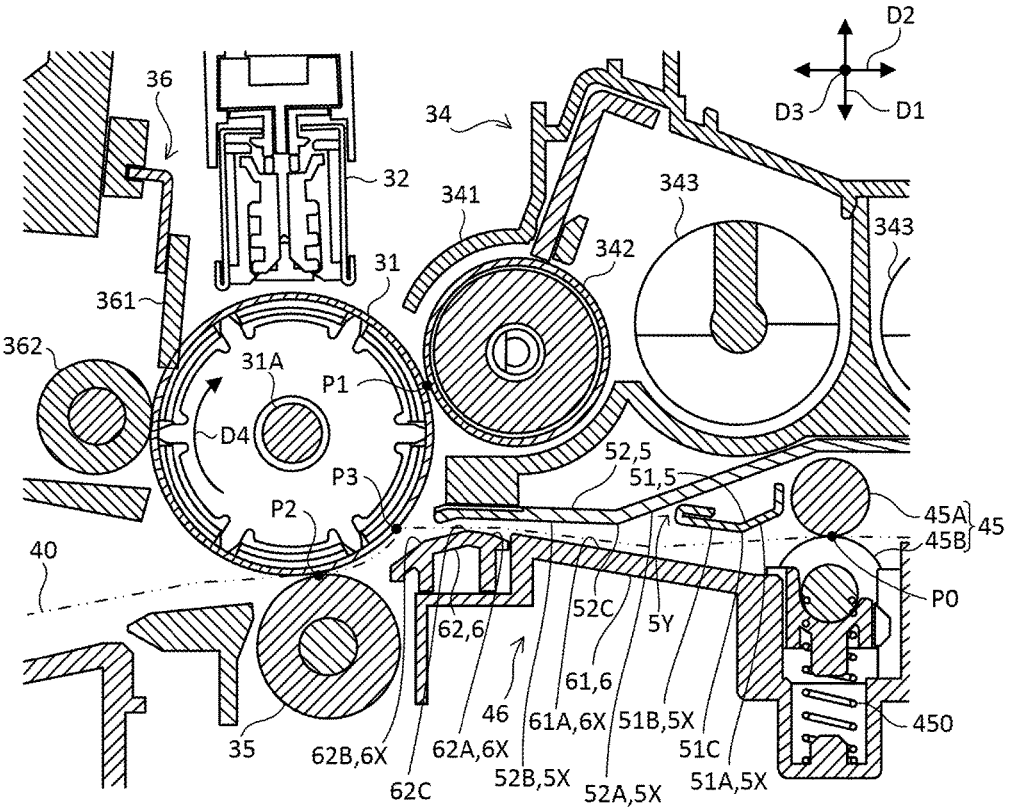
FIG. 2 is a configuration diagram of a sheet guide and its peripheral in the image forming apparatus according to the embodiment.

As shown in FIG. 2, the pair of registration rollers 45 includes a driving roller 45A and a driven roller 45B, wherein the driving roller 45A is rotationally driven by a motor (not shown), and the driven roller 45B is pressed against the driving roller 45A by an elastic force of a spring 450.

An outer layer portion of the driving roller 45A is a member formed from a metal such as stainless steel. On the other hand, an outer layer portion of the driven roller 45B is an elastic member formed from, for example, the EPDM rubber. The driven roller 45B rotates following the rotation of the driving roller 45A.

In the following description, a nip portion of the pair of registration rollers 45 through which the sheet 9 passes is referred to as a registration nip portion P0. In addition, a side of the sheet 9 facing the photoconductor 31 is referred to as a first surface, and a side of the sheet 9 opposite to the first surface is referred to as a second surface. The first surface of the sheet 9 is a side of the sheet 9 to which the toner image is transferred when the sheet 9 passes through the registration nip portion P0 and the transfer position P2.

The sheet guide 46 is disposed between the pair of registration rollers 45 and the photoconductor 31. The sheet guide 46 guides a forward end 9A of the sheet 9 conveyed by the pair of registration rollers 45, to a target position P3 on the outer circumferential surface of the photoconductor 31. The target position P3 is located between the developing position P1 and the transfer position P2 on the outer circumferential surface of the photoconductor 31. In general, the target position P3 is closer to the transfer position P2 than to the developing position P1.

After reaching the target position P3 on the photoconductor 31, the forward end 9A of the sheet 9 moves along the outer circumferential surface of the photoconductor 31 to the transfer position P2. The sheet 9 then passes through the transfer position P2. At the transfer position P2, the nip portion is formed between the photoconductor 31 and the image transfer member 35.

The fixing unit 37 fixes the toner image transferred to the sheet 9, to the sheet 9 by heating the toner image.

The pair of discharge rollers 47 discharge the sheet 9 that has passed through the fixing unit 37, onto the discharge tray 48 from the outlet port of the conveyance path 40.

[Outline of Sheet Guide 46]

As shown in FIG. 2, the sheet guide 46 includes a first sheet guide 5 and a second sheet guide 6 that respectively face the first surface and the second surface of the sheet 9.

The first sheet guide 5 includes a first upstream guide member 51 and a first downstream guide member 52. The first downstream guide member 52 is separate from the first upstream guide member 51. Similarly, the second sheet guide 6 includes a second upstream guide member 61 and a second downstream guide member 62. The second downstream guide member 62 is integrally coupled with the second upstream guide member 61.

The first upstream guide member 51 and the second upstream guide member 61 are attached to the main body portion 10A. On the other hand, the first downstream guide member 52 is attached to the housing 341 of the developing unit 34. As a result, it is possible to open the conveyance path 40 in the sheet guide 46 by detaching the developing unit 34 from the main body portion 10A. For example, when the sheet 9 is jammed in the sheet guide 46, the developing unit 34 can be removed from the main body portion 10A.

The first upstream guide member 51 includes a base member and a plating formed on the surface of the base member, wherein the base member is formed from a metal such as iron, and the plating is, for example, zinc plating. The first downstream guide member 52 is formed from a metal such as stainless steel. In addition, the second upstream guide member 61 and the second downstream guide member 62 are formed from, for example, a conductive synthetic resin including PPE (polyphenyl ether) and PS (polystyrene).

The first upstream guide member 51 and the first downstream guide member 52 include a first guide surface 5X that faces the first surface of the sheet 9, and the second upstream guide member 61 and the second downstream guide member 62 include a second guide surface 6X that faces the second surface of the sheet 9.

The first guide surface 5X guides the first surface of the sheet 9, and the second guide surface 6X guides the second surface of the sheet 9.

The first guide surface 5X includes: an upstream front guide surface 51A and an upstream rear guide surface 51B that are included in the first upstream guide member 51; and a downstream front guide surface 52A and a downstream rear guide surface 52B that are included in the first downstream guide member 52.

The upstream front guide surface 51A, the upstream rear guide surface 51B, the downstream front guide surface 52A, and the downstream rear guide surface 52B are formed in the stated order from the upstream side in the conveyance direction D5. That is, the upstream rear guide surface 51B is located on the downstream side of the upstream front guide surface 51A, the downstream front guide surface 52A is located on the downstream side of the upstream rear guide surface 51B, and the downstream rear guide surface 52B is located on the downstream side of the downstream front guide surface 52A, respectively in the conveyance direction D5.

On the other hand, the second guide surface 6X includes: an upstream guide surface 61A included in the second upstream guide member 61; and a downstream front guide surface 62A and a downstream rear guide surface 62B included in the second downstream guide member 62.

The upstream guide surface 61A, the downstream front guide surface 62A, and the downstream rear guide surface 62B are formed in the stated order from the upstream side in the conveyance direction D5. That is, the downstream front guide surface 62A is located on the downstream side of the upstream guide surface 61A, and the downstream rear guide surface 62B is located on the downstream side of the downstream front guide surface 62A, respectively in the conveyance direction D5.

With the above-described configuration where each of the first sheet guide 5 and the second sheet guide 6 is composed of a plurality of guide members, the sheet guide 46 for guiding the sheet 9 along an intended curved path can be configured from a plurality of members that are relatively small and have simple shapes.

Meanwhile, in a case where the plurality of guide members 51 and 52 constituting the first sheet guide 5 are disposed along the conveyance direction D5, the first guide surface 5X is divided into: the upstream rear guide surface 51B located on the upstream side in the conveyance direction D5; and the downstream front guide surface 52A located on the downstream side. As a result, a gap 5Y is formed between the upstream rear guide surface 51B and the downstream front guide surface 52A.

In a conventional image forming apparatus, when the sheet 9 is conveyed in a state where a rear end 9B of the sheet 9 slides in contact with the upstream rear guide surface 51B, at the moment the rear end 9B of the sheet 9 is separated from the upstream rear guide surface 51B, the rear end 9B springs toward the gap 5Y by the elasticity of the sheet 9.

When the rear end 9B of the sheet 9 springs energetically, the sheet 9 is instantaneously displaced, which causes an instantaneous change in the atmospheric pressure around the sheet 9, and the instantaneous change of the atmospheric pressure causes scattering of the toner carried by the photoconductor 31.

When the toner on the photoconductor 31 is scattered, the scattered toner may smear the surroundings of the photoconductor 31, and distort the toner image that is to be transferred to the sheet 9.

On the other hand, the sheet guide 46 of the image forming apparatus 10 has a structure to prevent the rear end 9B of the sheet 9 from springing energetically. This makes it possible for the sheet guide 46 to prevent the scattering of the toner and the distortion of the toner image that are caused by the springing of the rear end 9B of the sheet 9. The following describes the detail of the sheet guide 46.

[Detail of Sheet Guide 46]

Figure 3:
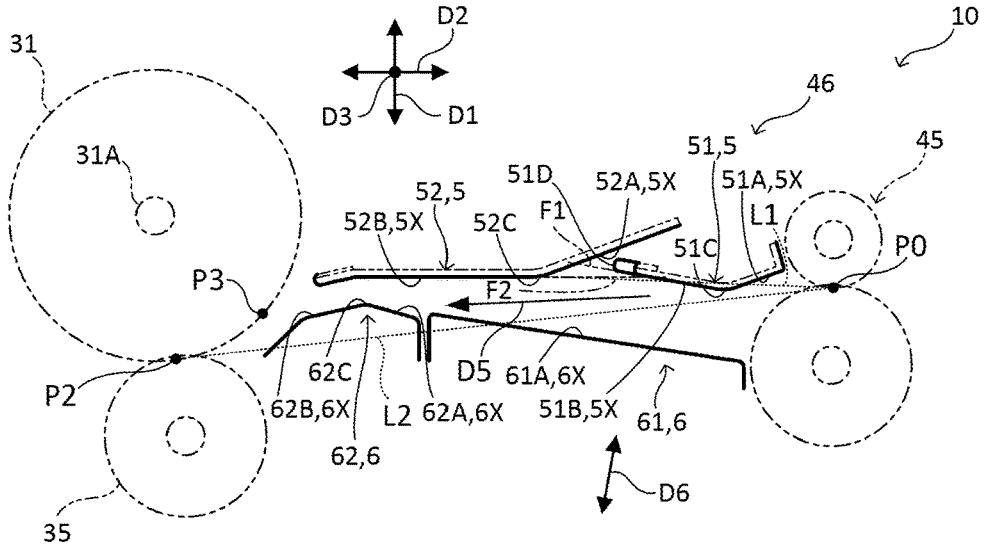
FIG. 3 is a side view of a guide surface of the sheet guide in the image forming apparatus according to the embodiment.

As shown in FIG. 2 and FIG. 3, in the first upstream guide member 51, the upstream front guide surface 51A and the upstream rear guide surface 51B are formed to be continuously connected from the upstream side to the downstream side in the conveyance direction D5. As described above, the upstream front guide surface 51A and the upstream rear guide surface 51B constitute a part of the first guide surface 5X.

The first upstream guide member 51 includes a first intermediate convex portion 51C that has a convex shape and is formed to project toward the second guide surface 6X at a boundary between the upstream front guide surface 51A and the upstream rear guide surface 51B.

In addition, in the first downstream guide member 52, the downstream front guide surface 52A and the downstream rear guide surface 52B are formed to be continuously connected from the upstream side to the downstream side in the conveyance direction D5. The downstream front guide surface 52A and the downstream rear guide surface 52B constitute a part of the first guide surface 5X.

The first downstream guide member 52 includes a second intermediate convex portion 52C that has a convex shape and is formed to project toward the second guide surface 6X at a boundary between the downstream front guide surface 52A and the downstream rear guide surface 52B.

In the second downstream guide member 62, the downstream front guide surface 62A and the downstream rear guide surface 62B are formed to be continuously connected from the upstream side to the downstream side in the conveyance direction D5. The downstream front guide surface 62A and the downstream rear guide surface 62B constitute a part of the second guide surface 6X.

The second downstream guide member 62 includes a third intermediate convex portion 62C that has a convex shape and is formed to project toward the first guide surface 5X at a boundary between the downstream front guide surface 62A and the downstream rear guide surface 62B.

As shown in FIG. 3, the downstream front guide surface 52A of the first downstream guide member 52 intersects with an imaginary plane F1 that is formed by extending the upstream rear guide surface 51B of the first upstream guide member 51 toward the downstream side in the conveyance direction D5.

In addition, the upstream rear guide surface 51B of the first upstream guide member 51 intersects with an imaginary plane F2 that is formed by extending the downstream rear guide surface 52B of the first downstream guide member 52 toward the upstream side in the conveyance direction D5.

Furthermore, when viewed from the width direction D3, the first intermediate convex portion 51C projects toward the upstream guide surface 61A of the second upstream guide member 61 beyond a straight line L1 that connects the second intermediate convex portion 52C and the registration nip portion P0. It is noted that the width direction D3 extends along a rotation shaft 31A of the photoconductor 31.

In addition, when viewed from the width direction D3, the third intermediate convex portion 62C, at a position located on the downstream side of the second intermediate convex portion 52C in the conveyance direction D5, projects toward the downstream rear guide surface 52B beyond a straight line L2 that connects the transfer position P2 and the registration nip portion P0.

Figure 4:
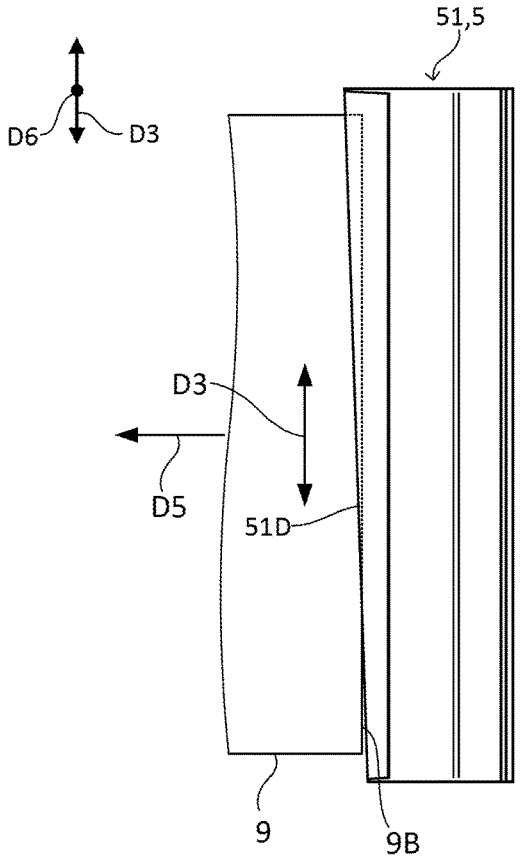
FIG. 4 is a diagram showing a first example of a shape of an edge portion of a first upstream guide member in the sheet guide of the image forming apparatus according to the embodiment.
Figure 5:
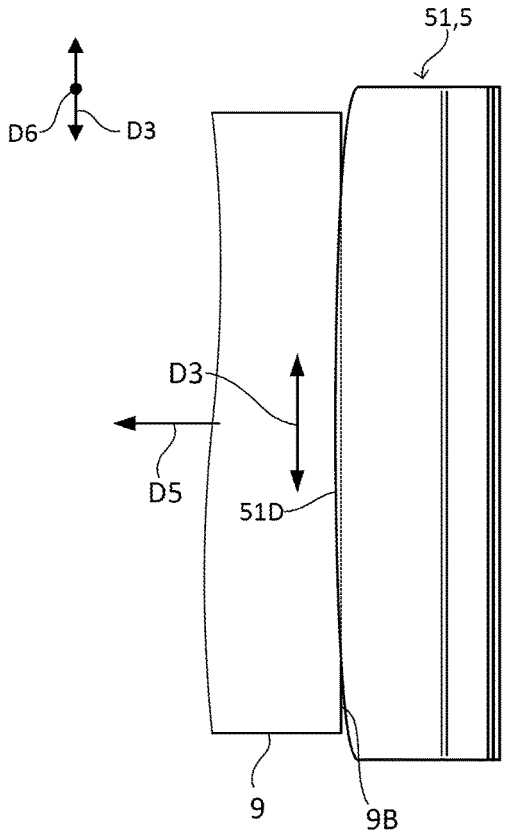
FIG. 5 is a diagram showing a second example of the shape of the edge portion of the first upstream guide member in the sheet guide of the image forming apparatus according to the embodiment.

In addition, when viewed from a direction D6 perpendicular to the upstream rear guide surface 51B, an edge portion 51D of the first upstream guide member 51 that is located on the downstream side in the conveyance direction D5, is inclined with respect to the width direction D3, in a manner as shown in FIG. 4 or FIG. 5. It is noted that the width direction D3 is perpendicular to the conveyance direction D5.

In the example shown in FIG. 4, when viewed from the direction D6 perpendicular to the upstream rear guide surface 51B, the edge portion 51D of the first upstream guide member 51 in a range from one of opposite ends thereof to the other in the width direction D3, is inclined straightly with respect to the width direction D3.

In the example shown in FIG. 5, when viewed from the direction D6 perpendicular to the upstream rear guide surface 51B, the edge portion 51D of the first upstream guide member 51 in a range from the center to each of the opposite ends, is inclined in a curve with respect to the width direction D3.

[Examples of State of Sheet 9 Passing Through Sheet Guide 46]

In the following, specific examples of the state of the sheet 9 passing through the sheet guide 46 are explained, with reference to FIG. 6 to FIG. 9.

In the present embodiment, the peripheral speed of the pair of registration rollers 45 is higher than the peripheral speed of the photoconductor 31, and the peripheral speed of the image transfer member 35 is higher than the peripheral speed of pair of registration rollers 45. For example, the peripheral speed of the pair of registration rollers 45 is approximately 1.5% higher than the peripheral speed of the photoconductor 31. In addition, the peripheral speed of the image transfer member 35 is approximately 5% higher than the peripheral speed of the photoconductor 31.

In the above-mentioned case, when an image of a low printing rate is transferred to the sheet 9, the sheet 9 is apt to adhere to the outer circumferential surface of the photoconductor 31, and the conveyance speed of the sheet 9 at the transfer position P2 is lower than the conveyance speed of the sheet 9 at the registration nip portion P0. It is noted here that the conveyance speed of the sheet 9 at the registration nip portion P0 is approximately the same as the peripheral speed of the pair of registration rollers 45.

For example, when an image of a low printing rate close to that of "no image" is transferred to the sheet 9, the conveyance speed of the sheet 9 at the transfer position P2 becomes approximately 1% higher than the peripheral speed of the photoconductor 31. This speed is lower than the conveyance speed of the sheet 9 at the registration nip portion P0.

Figure 6:
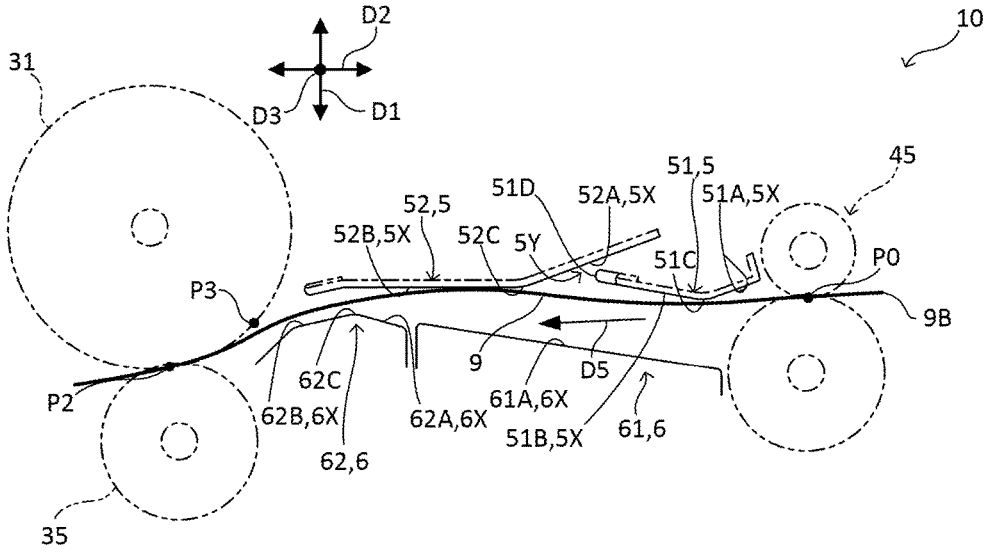
FIG. 6 is a side view of a sheet in a first state that is passing through the sheet guide in the image forming apparatus according to the embodiment, and the guide surface of the sheet guide.
Figure 7:
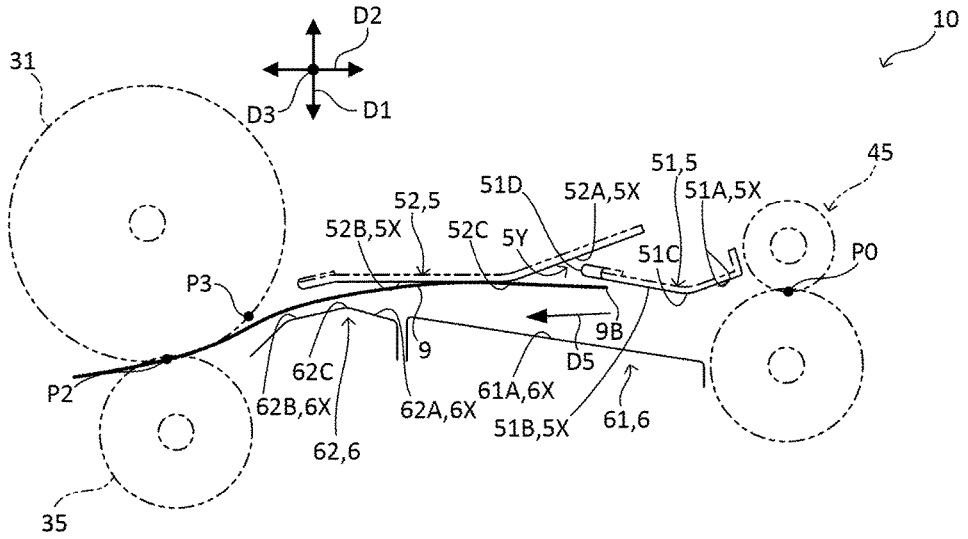
FIG. 7 is a side view of the sheet in a second state that is passing through the sheet guide in the image forming apparatus according to the embodiment, and the guide surface of the sheet guide.

As a result, as shown in FIG. 6, in the case where an image of a low printing rate is transferred to the sheet 9, the sheet 9 is curved such that it is mainly in contact with the downstream rear guide surface 52B. When the sheet 9 is conveyed in this state, the rear end 9B of the sheet 9 does not come into strong contact with the upstream rear guide surface 51B and maintains that state when passing the edge portion 51D of the first upstream guide member 51 that is located on the downstream side. As a result, the phenomenon that, at the moment when the rear end 9B of the sheet 9 is separated from the upstream rear guide surface 51B, the rear end 9B springs energetically toward the gap 5Y by the elasticity of the sheet 9, does not occur (see FIG. 7).

On the other hand, when a gray image of a high printing rate is transferred to the sheet 9, the conveyance speed of the sheet 9 at the transfer position P2 becomes approximately 1.8% higher than the peripheral speed of the photoconductor 31. This speed is higher than the conveyance speed of the sheet 9 at the registration nip portion P0.

Figure 8:
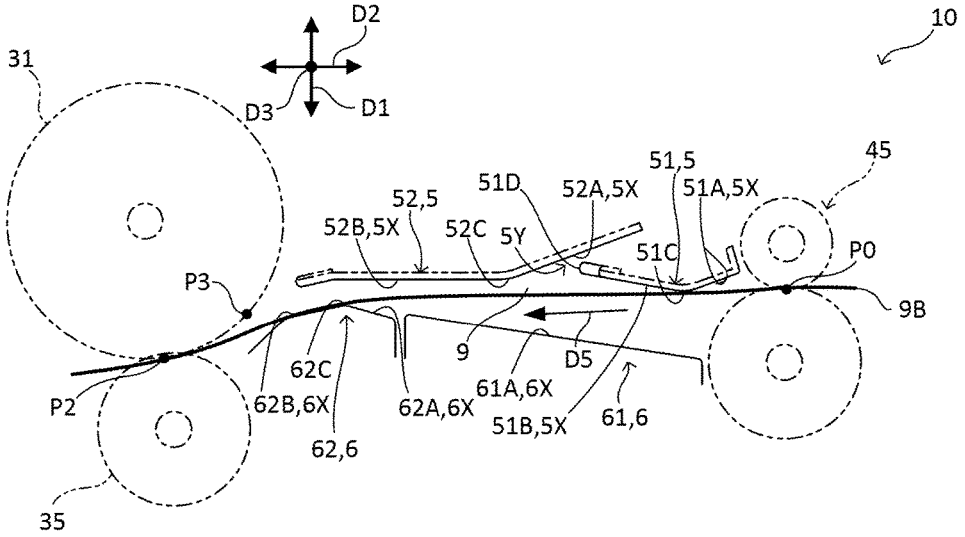
FIG. 8 is a side view of the sheet in a third state that is passing through the sheet guide in the image forming apparatus according to the embodiment, and the guide surface of the sheet guide.
Figure 9:
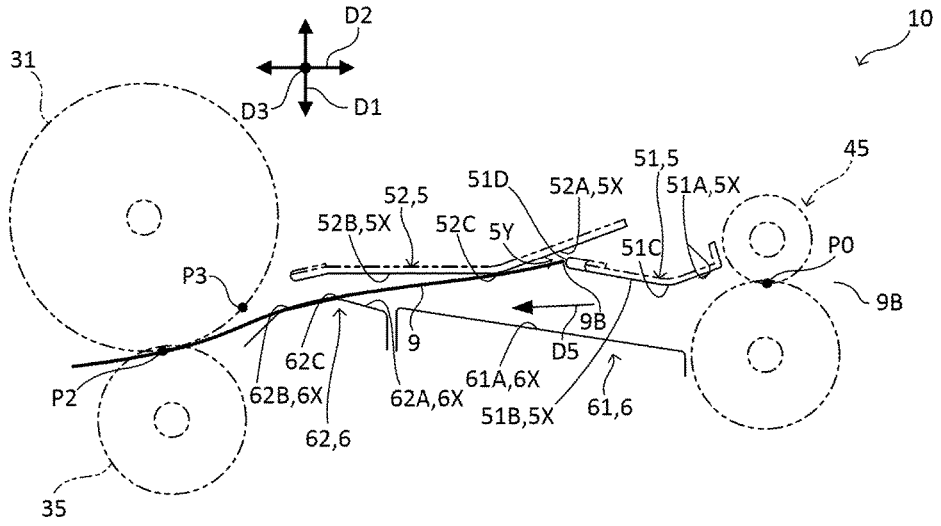
FIG. 9 is a side view of the sheet in a fourth state that is passing through the sheet guide in the image forming apparatus according to the embodiment, and the guide surface of the sheet guide.

As a result, as shown in FIG. 8, when an image of a high printing rate is transferred to the sheet 9, the sheet 9 is pulled between the registration nip portion P0 and the transfer position P2, and mainly comes into contact with the downstream rear guide surface 62B and the upstream rear guide surface 51B. When the sheet 9 is conveyed in this state, the rear end 9B of the sheet 9 comes into strong contact with the upstream rear guide surface 51B and maintains that state when passing the edge portion 51D of the first upstream guide member 51 that is located on the downstream side. Here, if the edge portion 51D were formed parallel to the width direction D3, at the moment when the rear end 9B of the sheet 9 is separated from the upstream rear guide surface 51B, the rear end 9B of the sheet 9 would spring energetically toward the gap 5Y by the elasticity of the sheet 9.

However, the edge portion 51D of the first upstream guide member 51 is inclined with respect to the width direction D3, in a manner as shown in FIG. 4 or FIG. 5. With this configuration, the rear end 9B of the sheet 9 is gradually separated from the edge portion 51D of the first upstream guide member 51 as the sheet 9 moves along the conveyance direction D5. As a result, the phenomenon that the rear end 9B of the sheet 9 springs energetically toward the gap 5Y, does not occur.

As described above, with the adoption of the image forming apparatus 10, it is possible to prevent the rear end 9B of the sheet 9 from energetically springing, even when the first guide surface 5X of the sheet guide 46 is divided into the upstream side and the downstream side in the conveyance direction D5. Accordingly, it is possible to prevent the scattering of the toner and the distortion of the toner image that are caused by the springing of the rear end 9B of the sheet 9.

Application Examples

In the sheet guide 46 described above, the first sheet guide 5 may include three guide members that are disposed in sequence from the upstream side to the downstream side in the conveyance direction D5. In this case, the first guide member is to the second guide member what the first upstream guide member 51 is to the first downstream guide member 52, and the second guide member is to the third guide member what the first upstream guide member 51 is to the first downstream guide member 52, wherein the first to the third guide members are counted up from the most upstream side in the conveyance direction D5. This also applies to the cases where the first sheet guide 5 includes four or more guide members.

In the sheet guide 46, the second upstream guide member 61 and the second downstream guide member 62 may be integrated into one member.

It is noted that the image forming apparatus of the present disclosure may be configured by freely combining, within the scope of claims, the above-described embodiments and application examples, or by modifying the embodiments and application examples or omitting a part thereof.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

an image carrying member which is configured to rotate in a predetermined direction and on whose outer circumferential surface, an electrostatic latent image is formed;

a developing unit configured to develop the electrostatic latent image as a toner image at a developing position on the outer circumferential surface of the image carrying member;

an image transfer member configured to rotate facing a transfer position on the outer circumferential surface of the image carrying member, and transfer the toner image to a first surface of a sheet, while conveying the sheet between it and the image carrying member;

a pair of conveyance rollers configured to convey the sheet toward the image carrying member; and a sheet guide disposed between the pair of conveyance rollers and the image carrying member, having a first guide surface and a second guide surface, and configured to guide a forward end of the sheet conveyed by the pair of conveyance rollers to a target position between the developing position and the transfer position on the outer circumferential surface of the image carrying member, the first guide surface and the second guide surface respectively facing the first surface and a second surface of the sheet, the second surface being opposite to the first surface, wherein the sheet guide includes:

a first upstream guide member including: an upstream front guide surface and an upstream rear guide surface that constitute a part of the first guide surface and are arranged in sequence from an upstream side to a downstream side in a conveyance direction of the sheet; and a first intermediate convex portion that has a convex shape and is formed to project toward the second guide surface at a boundary between the upstream front guide surface and the upstream rear guide surface; and a first downstream guide member that is separate from the first upstream guide member and includes: a downstream front guide surface and a downstream rear guide surface that, on the downstream side of the upstream rear guide surface in the conveyance direction, constitute another part of the first guide surface and are arranged in sequence from the upstream side to the downstream side in the conveyance direction; and a second intermediate convex portion that has a convex shape and is formed to project toward the second guide surface at a boundary between the downstream front guide surface and the downstream rear guide surface, the downstream front guide surface intersects with an imaginary plane that is formed by extending, toward the downstream side in the conveyance direction, the upstream rear guide surface, the upstream rear guide surface and the downstream front guide surface are formed to be separate from each other, the upstream front guide surface intersects with an imaginary plane that is formed by extending, toward the upstream side in the conveyance direction, the downstream rear guide surface, when viewed from a direction perpendicular to the upstream rear guide surface, an edge portion of the first upstream guide member that is located on the downstream side in the conveyance direction, is inclined with respect to a width direction perpendicular to the conveyance direction, no other pair of conveyance rollers is disposed in a part of a conveyance path of the sheet extending from a position between the pair of conveyance rollers to a position between the image carrying member and the image transfer member, the developing unit is attached to a main body portion of the image forming apparatus in a detachable manner, the first upstream guide member is attached to the main body portion, and the first downstream guide member is attached to the developing unit.

2. The image forming apparatus according to claim 1, wherein a peripheral speed of the pair of conveyance rollers is higher than a peripheral speed of the image carrying member, and a peripheral speed of the image transfer member is higher than the peripheral speed of the pair of conveyance rollers.

3. An image forming apparatus comprising:

an image carrying member which is configured to rotate in a predetermined direction and on whose outer circumferential surface, an electrostatic latent image is formed;

a developing unit configured to develop the electrostatic latent image as a toner image at a developing position on the outer circumferential surface of the image carrying member;

an image transfer member configured to rotate facing a transfer position on the outer circumferential surface of the image carrying member, and transfer the toner image to a first surface of a sheet, while conveying the sheet between it and the image carrying member;

a pair of conveyance rollers configured to convey the sheet toward the image carrying member; and a sheet guide disposed between the pair of conveyance rollers and the image carrying member, having a first guide surface and a second guide surface, and configured to guide a forward end of the sheet conveyed by the pair of conveyance rollers to a target position between the developing position and the transfer position on the outer circumferential surface of the image carrying member, the first guide surface and the second guide surface respectively facing the first surface and a second surface of the sheet, the second surface being opposite to the first surface, wherein the sheet guide includes:

a first upstream guide member including: an upstream front guide surface and an upstream rear guide surface that constitute a part of the first guide surface and are arranged in sequence from an upstream side to a downstream side in a conveyance direction of the sheet; and a first intermediate convex portion that has a convex shape and is formed to project toward the second guide surface at a boundary between the upstream front guide surface and the upstream rear guide surface; and a first downstream guide member that is separate from the first upstream guide member and includes: a downstream front guide surface and a downstream rear guide surface that, on the downstream side of the upstream rear guide surface in the conveyance direction, constitute another part of the first guide surface and are arranged in sequence from the upstream side to the downstream side in the conveyance direction; and a second intermediate convex portion that has a convex shape and is formed to project toward the second guide surface at a boundary between the downstream front guide surface and the downstream rear guide surface, the downstream front guide surface intersects with an imaginary plane that is formed by extending, toward the downstream side in the conveyance direction, the upstream rear guide surface, the upstream rear guide surface and the downstream front guide surface are formed to be separate from each other, the upstream front guide surface intersects with an imaginary plane that is formed by extending, toward the upstream side in the conveyance direction, the downstream rear guide surface, when viewed from a direction perpendicular to the upstream rear guide surface, an edge portion of the first upstream guide member that is located on the downstream side in the conveyance direction, is inclined with respect to a width direction perpendicular to the conveyance direction, no other pair of conveyance rollers is disposed in a part of a conveyance path of the sheet extending from a position between the pair of conveyance rollers to a position between the image carrying member and the image transfer member, and the second guide surface includes a third intermediate convex portion that, when viewed from a direction along a rotation shaft of the image carrying member, projects, at a position located on the downstream side of the second intermediate convex portion in the conveyance direction, toward the downstream rear guide surface beyond a straight line that connects the transfer position and a nip portion of the pair of conveyance rollers.

* * * * *